United States Patent [19]

Mason

[11] 4,164,966

[45] Aug. 21, 1979

[54] METHOD AND APPARATUS FOR SELF-FEEDING AND SAWING WOODEN WORKPIECES

[76] Inventor: Charles H. Mason, 748 Rosewood, Nacogdoches, Tex. 75961

[21] Appl. No.: 889,935

[22] Filed: Mar. 24, 1978

Related U.S. Application Data

[63] Continuation-in-part of Ser. No. 773,916, Mar. 3, 1977, abandoned, which is a continuation-in-part of Ser. No. 543,964, Jan. 24, 1975, abandoned.

[51] Int. Cl.[2] ..... B27B 5/02

[52] U.S. Cl. ..... 144/312; 83/425; 83/471.2; 144/218; 144/323

[58] Field of Search ..... 144/312, 326 R, 143, 144/242 R, 218, 230, 231, 323, 246 D; 83/9, 12, 425, 425.3, 426, 430, 450, 437, 471, 471.2, 508.2

[56] References Cited

U.S. PATENT DOCUMENTS

| | | | |
|---|---|---|---|
| 1,390,158 | 9/1921 | Phillips | 144/246 D |
| 2,673,580 | 3/1954 | Pierson | 83/425.3 |

*Primary Examiner*—Robert L. Spruill
*Assistant Examiner*—W. D. Bray
*Attorney, Agent, or Firm*—Dennison, Dennison, Meserole & Pollack

[57] ABSTRACT

A wooden workpiece is positioned on a saw table and introduced to a safety-back saw blade rotating in generally the same direction as the direction of introduction of the workpiece at the point of contact. The blade generates components of vertical and horizontal thrust of sufficient magnitude to self-feed either the workpiece or the saw, one relative to the other, at a rate compatible with the capability of the saw to cut the workpiece without generating sufficient thrust to propel the workpiece uncontrolled from the cutting and feeding operation.

3 Claims, 16 Drawing Figures

METHOD AND APPARATUS FOR SELF-FEEDING AND SAWING WOODEN WORKPIECES

This application is a continuation-in-part of my former application Ser. No. 773,916, filed Mar. 3, 1977, entitled "Method and Device for Cutting Wood", now abandoned which, in turn, is a continuation-in-part of my earlier filed application Ser. No. 543,964, filed Jan. 24, 1975, entitled "Method and Device for Cutting Wood", now abandoned.

BACKGROUND OF THE INVENTION

This invention is concerned generally with the method and apparatus for self-feeding rotary saws and more particularly, to the utilization of horizontal and vertical components of thrust developed by rotating saw blades positioned above the workpiece to both cut and feed the workpiece or saw, one relative to the other, without the necessity of external feeding means.

THE PRIOR ART

Insofar as I am aware, there are no rotary saws in existence which are capable of cutting wooden workpieces while simultaneously feeding themselves from power generated solely by the thrust developed by the rotating blade. Typically, self-feeding saws are characterized by some form of roller or conveyor means which grip and feed the workpiece into the saw, thus necessitating considerable additional machinery and regulating means for controlling the rate at which the workpiece is fed into the rotating cutter.

Typical examples of such prior art are seen in the patents to Dickson, U.S. Pat. No. 3,082,802, Key, U.S. Pat. No. 2,899,992, and Thrasher, U.S. Pat. No. 3,568,738, as well as the other patents mentioned in the specifications of each of my earlier filed patent applications which are incorporated herein by reference.

Significant problems attendant to the use of radial saws are the problems generally known as "kickback" and "overfeed." In most radial saws of which I am aware, including both table saws wherein the saw is mounted beneath the work table and radial arm saws wherein the saw is either fixedly or movably mounted above the work table, kickback and overfeed are prevalent. Overfeed occurs when an attempt is made to feed the wood workpiece into the saw blade in the same direction in which it is rotating, in which case, the saw grabs the wooden workpiece and propels the same uncontrolled through the saw, sometimes with violent force and effect. Kickback occurs when wooden workpieces are fed into a saw against the direction of rotation at a rate of feed which causes the saw to stall or approach stalling speed, at which point the workpiece is frequently projected backwardly against the direction of feed with uncontrolled and often violent results.

In an effort to overcome these problems, prior art saws such as those illustrated in the patents to Knowles, U.S. Pat. No. 7,603; Grupp, U.S. Pat. No. 2,559,355; Drake, U.S. Pat. No. 2,720,229; and Forsyth, U.S. Pat. No. 1,811,079, have been developed. Each of these saws and those which have been subsequently developed is designed to rotate against the direction of feed of the workpiece and includes a significant peripheral edge portion which is concentric with the arbor on which the saw is mounted. This peripheral edge generally illustrated at 9 in the patent to Forsyth, U.S. Pat. No. 1,811,079, is usually smooth in character and extends beween each of the several teeth and gullets positioned around the periphery of the blade.

In the patent to Grupp, U.S. Pat. No. 2,559,355, the concentric peripheral area is designated at 13 and, for purpose of this specification, will hereinafter be referred to as the "back" of the blade. As indicated in the Grupp specification, the actual cutting teeth mounted on the blade extend above the "back" a distance of approximately 0.7 mm. and these teeth constitute the sole cutting instrumentality on the periphery of the blade. Thus, as the blade rotates against the direction of feed, the individual teeth penetrate the workpiece seriatim and cut the kerf in successive steps. An intermittent cutting action is thus achieved during which the workpiece is advanced by the operator to engage the back of the blade and preclude further introduction of the workpiece until the next advancing tooth cuts away an appropriate portion of the kerf to allow further in-feed of the workpiece.

Such devices as this are now well known and accepted tools in the wood sawing arts and are generally referred to as "safety-back" or "safety-line" blades. Insofar as I am aware, however, all such blades have been utilized only where they are rotated against the direction of feed of the workpiece. The problem of kickback is thus effectively prevented by the safety-back blade because the wood cannot be fed into the rotating saw at a rate faster than the saw is capable of accommodating the same. Thus, no stall condition is induced and kickback is effectively precluded.

SUMMARY OF THE INVENTION

The present invention is concerned with the concept and technique for cutting and simultaneously feeding the workpiece or saw, one relative to the other, by utilizing the vertical and horizontal thrust components developed by the rotating saw blade. I have discovered that if a typical safety-back blade, such as those depicted in the patents to Knowles, Drake, Grupp, and Forsyth, is mounted on a radial arm saw rotating on an axis above the workpiece in a direction generally common to the direction of feed of the workpiece, the blade can be made to self-feed by positioning the blade with respect to the workpiece such that the horizontal and vertical thrust components are placed in a state of near balance with the horizontal thrust being sufficient to overcome the frictional engagement of the workpiece with the saw table and the vertical thrust component being sufficient to insure continued though sliding engagement of the workpiece with the saw table throughout the sawing operation. Alternatively, the workpiece can remain stationary and the saw can travel on its radial arm relative to a stationary workpiece to complete the cutting operation.

Thus, my invention contemplates utilizing the anti-kickback characteristics of a safety-back blade to generate feed forces sufficient to controllably feed a workpiece or a rotating saw, one relative to the other, without the need for any auxiliary feeding equipment and without incurring the undesired results of kickback and overfeed.

It is therefore an object of this invention to feed a wooden workpiece or a rotating radial arm saw blade, one relative to the other, by utilizing the thrust forces developed by the rotating blade to effect workpiece or saw feed.

It is another object of this invention to eliminate the need for ancillary feeding and gripping equipment which would grippingly support and feed the workpiece into the blade.

It is another object of this invention to utilize existing safety-back saw blades in a new manner to achieve a self-feeding sawing operation.

DESCRIPTION OF THE DRAWINGS

These and other objects of the invention will become apparent when taken in conjunction with the accompanying drawings in which like numerals refer to like parts through the several views and in which.

DESCRIPTION OF THE PREFERRED EMBODIMENT

Figure 1:
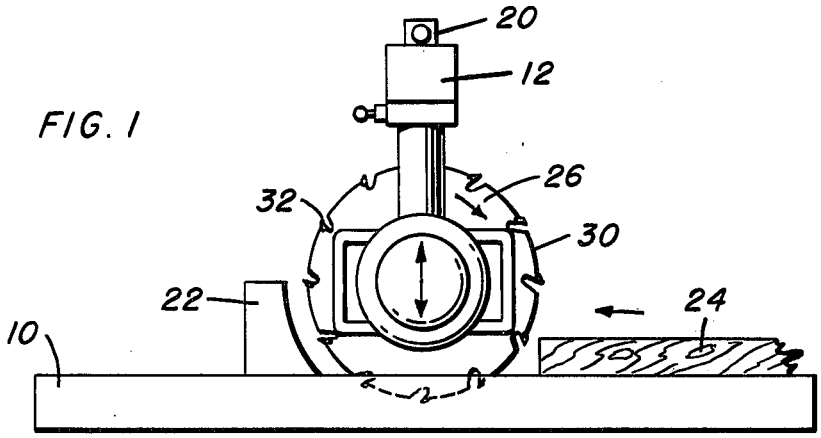
FIG. 1 is a front elevational view of the saw table with certain parts removed for illustration.

The present invention utilizes a conventional saw table, generally illustrated at 10, disposed beneath a radial arm 12 mounted on a vertically adjustable pedestal 14. Supported on the arm 12 for horizontal reciprocating movement thereon is a motor 16 and adjusting means 18 to selectively horizontally position the motor with respect to the pedestal 14. Adjusting means 20 on the pedestal 14 will provide vertical adjustment of the radial arm 12 and thus permit accommodation of workpieces of varying thicknesses. Alternatively, the blade may be mounted in a fixed horizontal and/or vertical position and the table 10 mounted for vertical and/or horizontal displacement. A further alternative arrangement contemplates a fixed table and saw arbor and variation in thickness of the workpiece may be accommodated by merely employing blades of differing diameters.

A kerf guide 22 may be employed to insure maintenance of appropriate kerf width during the sawing operation. A workpiece 24 is illustrated in a position to be advanced into the saw. A circular safety-back saw blade 26 is mounted on an arbor 28 and includes a peripheral back portion 30 concentric with a conventional center opening in the blade which accommodates the arbor 28.

Figure 4:
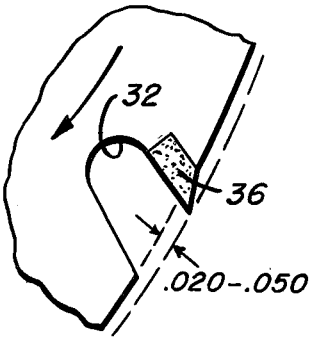
FIG. 4 is an enlarged fragmentary view of a segment of the saw illustrating the relationship of the cutting tooth to the blade back.
Figure 5:
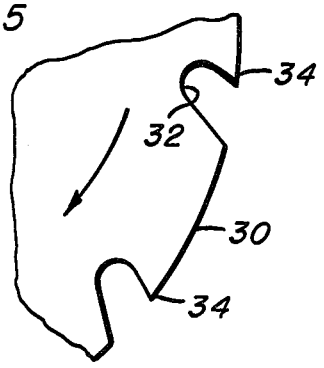
PRIOR ART FIG. 5
FIG. 5 is a fragmentary segment of a conventional safety-back blade.

A plurality of gullets 32 are positioned around the edge of the blade and extend thereinto to define recesses adapted to receive chip from the cutting operation. The trailing edge of each gullet terminates in a toothed segment of the blade 34 and may include an integrally formed tooth fashioned from the blade material itself, as illustrated in FIG. 5, or, as an alternative and preferred embodiment of this invention, a carbide insert 36 suitably welded to the blade body. Each of the inserts 36 is configured to extend slightly beyond the radial periphery of the disc and constitutes the cutting element of the saw blade. Except at the points of the tooth which extend beyond the periphery of the blade and the gullets 32, other peripheral portions of the blade are concentric with the central axis and those portions generally designated at 30 constitute the backs of the blade. Tooth extension, as illustrated diagrammatically in FIG. 4, of between 0.020 and 0.050 inches beyond the radial extremity of the "backs" has proved quite satisfactory.

Figure 6:
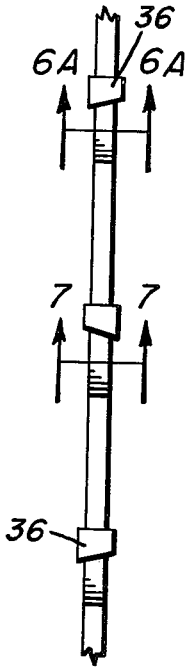
FIG. 6 is a fragmentary end view of a sefety-back blade of the type contemplated by this invention with parts enlarged for clarity.
Figure 6A:
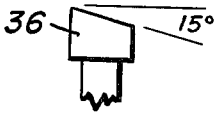
FIG. 6A is an enlarged fragmentary sectional view of one tooth configuration taken along the lines 6A—6A of FIG. 6.
Figure 6B:
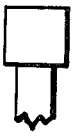
FIG. 6B is an enlarged fragmentary section of a modified tooth form.
Figure 6C:
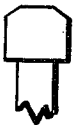
FIG. 6C is an enlarged fragmentary section of a second modification of tooth form.
Figure 7:
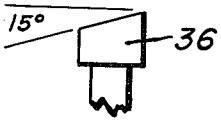
FIG. 7 is an enlarged fragmentary sectional view of a tooth taken along the line 7—7 of FIG. 6.

Each of the teeth may be ground to a configuration generally illustrated in cross-section in FIGS. 6 and 6A wherein alternate teeth are ground in opposite directions on an angle of approximately 15°. Other tooth configurations and combinations may be employed and, as an example, square tipped teeth, as illustrated in FIG. 6B, and symmetrical beveled teeth, as illustrated in FIG. 6C, may be utilized.

Figure 8:
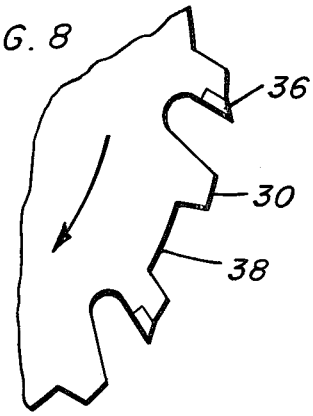
FIG. 8 is a fragmentary side elevational view of a segment of a modified form of safety back blade.

The blade may include as an alternative construction an interrupted back, as seen in FIG. 8 of the drawings, wherein a relieved area 38 adjacent the rear of the cutting tooth extends along the blade periphery to a point adjacent the next gullet where the back configuration again extends radially outwardly to define a back edge surface 30 concentric with the axis of the blade body.

OPERATION

In operation, the blade as viewed in the illustrations herein contained is designed to operate in a clockwise direction, as viewed in the drawings, and is positioned for rotation on an arbor 28 above the work table 10 on which the workpiece 24 is supported.

Figure 2:
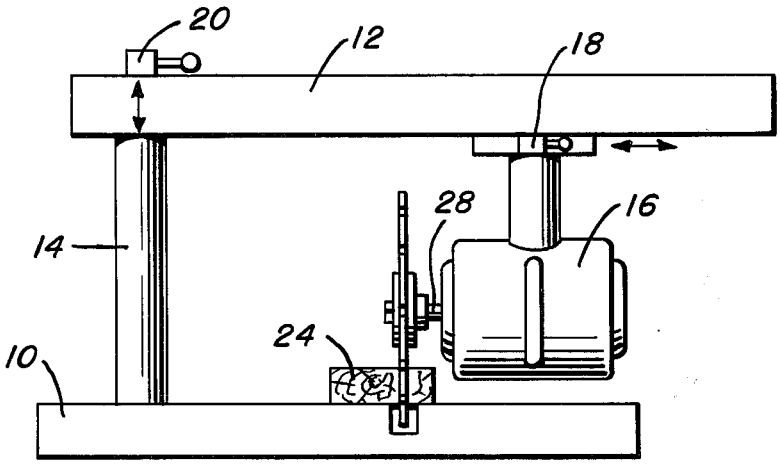
FIG. 2 is a side elevational view of the saw table and the supporting structure for the rotating saw blade with parts removed for purposes of illustration.

The blade is adjusted vertically to accommodate the depth of cut desired and the workpiece introduced to the rotating blade in the manner illustrated in FIG. 1. It is to be understood that in the embodiment illustrated in FIGS. 1 and 2, the workpiece is intended to move relative to the fixed blade. It is, however, clearly within the contemplation of the invention that the blade can move with equal facility with respect to a fixed workpiece by merely moving along the radial arm support.

Figure 3:
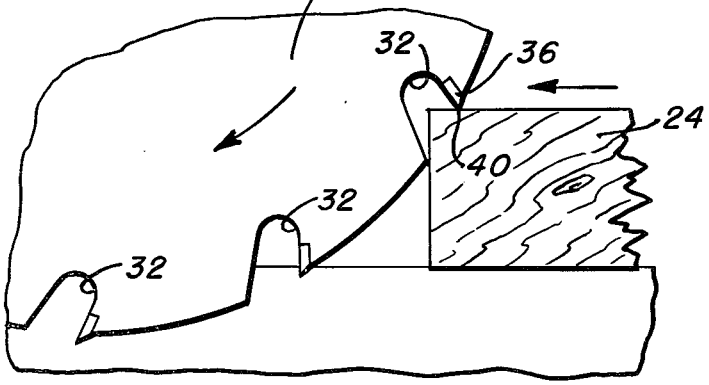
FIG. 3 is a fragmentary side elevational view on enlarged scale of a segment of the saw blade of my invention and its relationship to a workpiece.
Figure 9:
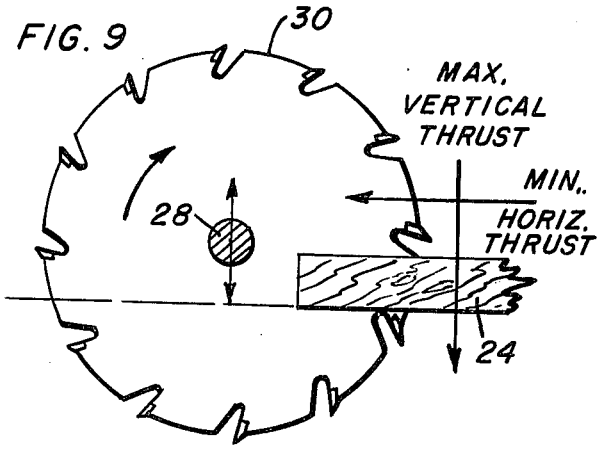
FIGS. 9, 10, and 11 are side elevational views of a blade of the invention with wooden workpieces positioned to demonstrate the varying qualities of vertical and horizontal thrust.

Attention is now directed to FIG. 3 wherein an enlarged view of the relationship between the advancing workpiece 24 and rotating blade 26 will be seen. In this view, it will be noted that the tooth 35 engages the edge 40 of the workpiece and proceeds therethrough in a cutting action forming an arcuate kerf. As hereinbefore indicated, the rotation of the blade develops components of vertical thrust and horizontal thrust which are applied to the workpiece as it is engaged by the teeth of the blade intermittently. As seen in FIG. 9, maximum vertical thrust urging the workpiece into contact with the work table will be achieved when the angle of attack of the cutter tooth at the point of contact with the workpiece is substantially in a vertical direction.

Figure 10:
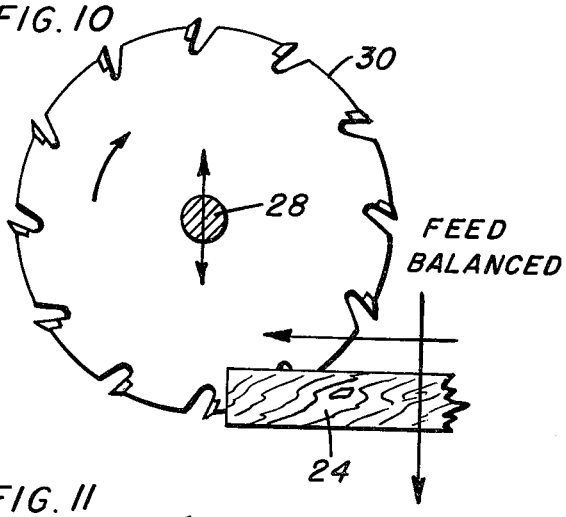
Figure 11:
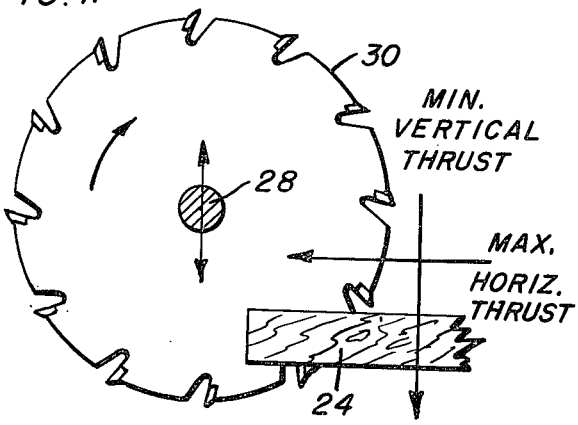

In the FIG. 11 illustration, maximum horizontal thrust forces are applied to the workpiece in view of the angle of attack of the rotating teeth and the arc of the kerf cut thereby. Thus, while in the FIG. 9 configuration, little or no self-feeding action would be achieved, the FIG. 10 illustration characterizes a maximum self-feeding action.

In FIG. 10, a more typical feeding arrangement is illustrated. In this view, the workpiece is subjected to a more balanced application of vertical and horizontal thrust components and thus, the self-feeding action is adequate, but does not exceed the capability of the saw to accept the workpiece and cut the same continuously.

In order to accommodate the saw to workpieces of various thickness and degrees of hardness, the workpiece may be placed on the table adjacent the saw and slightly therebeneath and the saw lowered into position while simultaneously restraining the workpiece until controlled feed is achieved. Conversely, the saw may be initially positioned to the approximate relationship illustrated in FIG. 10 and workpieces successively introduced and vertical saw adjustments made until self-feeding action at the desired rate is achieved.

Figure 12:
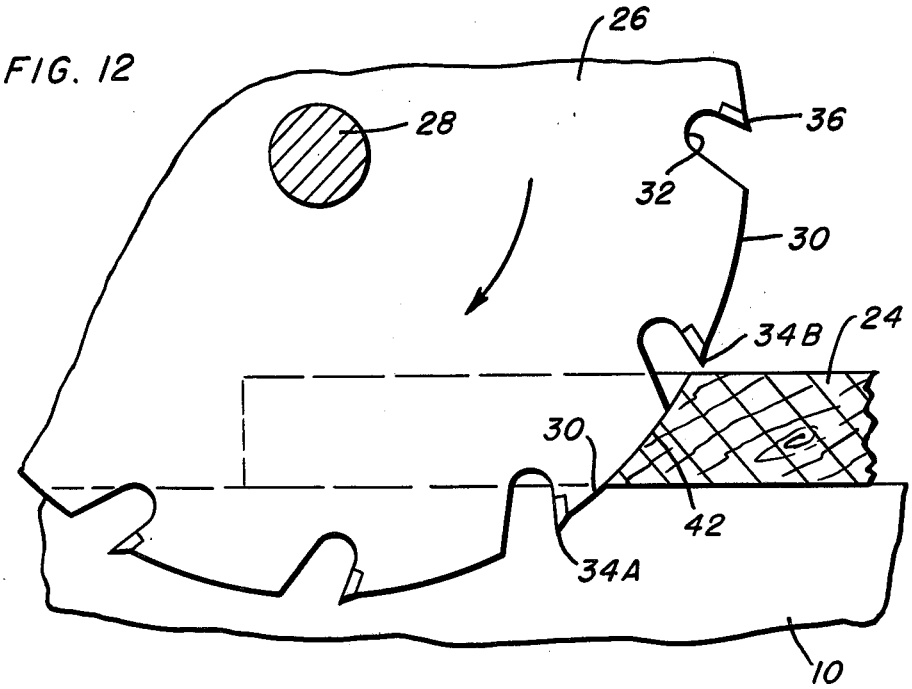
FIG. 12 is an enlarged fragmentary side elevational view of the workpiece and saw blade with the blade positioned for non-cutting engagement with the workpiece.
Figure 13:
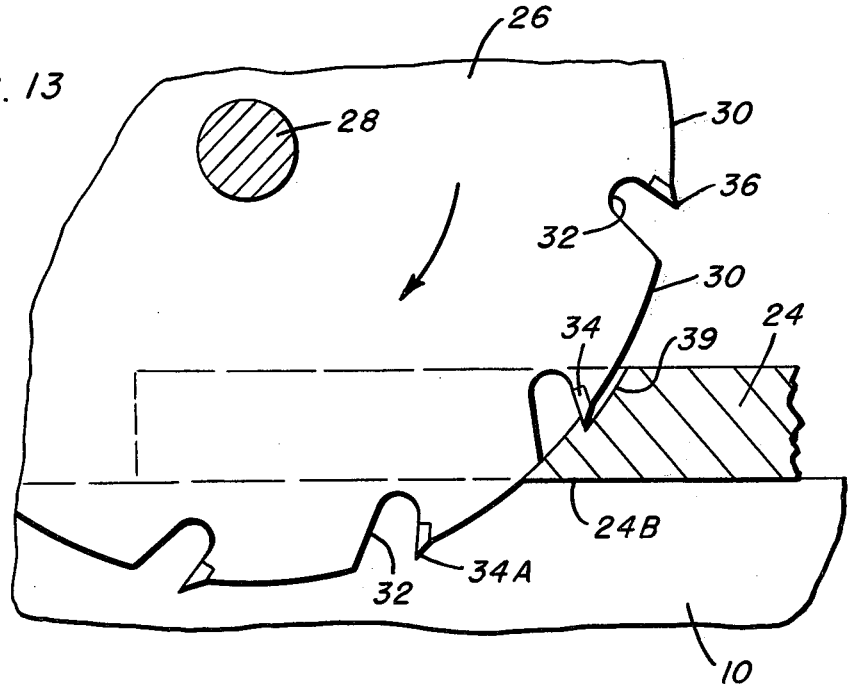
FIG. 13 is an enlarged fragmentary side elevational view of the saw blade with the workpiece positioned in cutting relationship to the blade.

FIGS. 12 and 13 of the drawings illustrate the relationship of the blade 26 and the workpieces 24 during the cutting and simultaneous feeding operation. In FIG. 12, the tooth 34A is seen to have advanced through the workpiece and as illustrated, the end wall of the kerf 42 is in engagement with the back of the blade 30. Further introduction of the workpiece into the rotating blade is thus precluded by the back portion. Tooth 34B is seen disposed immediately above the upper surface of the workpiece ready to engage and cut the same to the extent of its depth capabilities as the blade rotates. This position is seen best in FIG. 13 where tooth 34A and its companion gullet have advanced out of the lower side of the workpiece 24B, while tooth 34B has extended through the upper surface of the workpiece and formed a stepped kerf wall 39, as illustrated.

This cutting and rotating action by the tooth extends the kerf wall deeper into the wood while simultaneously imparting a component of horizontal thrust as it attempts to "drag" the wood further into the saw. Such action will effect an intermittent feed and stop action operating at a rate of speed fast enough to appear to the naked eye to be continuous. Obviously, the rate of feed can be modified by utilization of blades with fewer teeth and/or increased or decreased rotational speeds of the blade.

Since the blade is moving in an arc, the cutting tooth applies a vertical force component on the workpiece as well as a horizontal force component, thus urging the workpiece into intimate but sliding contact with the support surface.

By way of example and illustrating an enabling embodiment of the invention, a 12" diameter blade equipped with 12 equally spaced carbide teeth of conventional configuration was purchased from Sears & Roebuck on their Catalog No. M32469. Such blade was mounted on a 7½ HP motor operating at 3600 rpm and 1" of the saw blade was positioned to penetrate the saw table top. Several species of wood were introduced into the rotating blade including Mexican oak 2¾" thick, kiln dried white oak 1" thick, ¾" Redwood, 1⅛" Cherry, ½" and ¾" plywood, and ⅝" particle board were utilized.

Once the wood had been introduced to the blade, the remainder of the wood self-fed at controlled speeds and were completely severed leaving a smooth walled kerf. Improved feeding and smoother kerf wall finish was achieved by modifying the blade teeth to include a 15° angle, as illustrated in FIG. 6 of the drawings, with the angle formed on opposite sides of alternate teeth. In each of these examples, with the exception of the plywood and particle board, the sawing operation was a rip-sawing and cross-cutting procedure and the blade position remained fixed while the workpiece advanced through the blade. It is to be understood that this invention will work equally well in the cut-off or cross-cut configuration by merely permitting the blade and motor to advance along the radial arm under the blade geneerated thrust forces and thus permitting the blade to move relative to the work, although some vertical adjustment may be required in order to achieve sufficient horizontal thrust to move the blade and motor across the workpiece.

Although the invention has been described and illustrated with respect to a preferred embodiment, it will be obvious that various modifications and changes may be accommodated without departing from the spirit of the invention or the scope of the appended claims.

I claim:

1. The method of sawing wooden workpieces of varying thickness, degree of hardness and differing grain pattern positioned on a support surface comprising the steps of:

(a) positioning a circular safety-back toothed saw blade for rotation on an axis above said workpiece and said support surface, said blade including an advancing segment and a retreating segment, said advancing segment constituting that portion of said blade, the periphery of which is moving downwardly with respect to said support when said blade is rotating, and said retreating segment constituting that portion of said blade which is moving upwardly with respect to said support when said blade is rotated;

(b) rotating said blade relative to said support and said workpiece at a speed sufficient to saw said workpiece and wherein said teeth on said advancing segment simultaneously generate and apply to said workpiece a sufficient combination of horizontal and vertical thrust to selectively move said workpiece and said saw one with respect to the other at a rate compatible with the ability of said saw to simultaneously cut and feed said workpiece and said saw one with respect to the other;

(c) adjusting the position of said blade, said support and said workpiece relative to each other during initial contact between said blade and said workpiece and continuing the adjustment until a relative position is reached between positions of blade generated maximum vertical thrust and minimum horizontal thrust on the workpiece on the one hand and blade generated minimum vertical thrust and maximum horizontal thrust on the workpiece on the other hand sufficient to effect simultaneous cutting and feeding of said saw and said workpiece one with respect to the other; and (d) permitting said workpiece and said saw to move one with respect to the other to complete said cutting and feeding function to a predetermined degree due solely to the rotation of the blade and the relative positions of the blade and workpiece.

2. The method of sawing wooden workpieces of varying thickness, degree of hardness and differing grain pattern positioned on a support surface comprising the steps of:

(a) positioning a circular safety-back toothed saw blade for rotation on an axis above said workpiece and said support surface, said blade including an advancing segment and a retreating segment, said advancing segment constituting that portion of said blade, the periphery of which is moving downwardly with respect to said support when said blade is rotating, and said retreating segment constituting that portion of said blade which is moving upwardly with respect to said support when said blade is rotated;

(b) rotating said blade relative to said support and said workpiece at a speed sufficient to saw said workpiece and wherein said teeth on said advancing segment simultaneously generate and apply to said workpiece a sufficient combination of horizontal and vertical thrust to selectively move said workpiece relative to said saw at a rate compatible with the ability of said saw to simultaneously cut and feed said workpiece;

(c) adjusting the position of said blade, said support and said workpiece relative to each other during initial contact between said blade and said workpiece and continuing the adjustment until a relative position is reached between positions of blade generated maximum vertical thrust and minimum horizontal thrust on the workpiece on the one hand and blade generated minimum vertical thrust and maximum horizontal thrust on the workpiece on the other hand sufficient to effect simultaneous cutting by said saw and feeding of said workpiece in the direction of rotation of said saw blade;

(d) permitting said workpiece and said saw to move one with respect to the other to complete said cutting and feeding function to a predetermined degree due solely to the rotation of the blade and the relative positions of the blade and workpiece.

3. The method of sawing wooden workpieces of varying thickness, degree of hardness and differing grain pattern positioned on a support surface comprising the steps of:

(a) positioning a circular safety-back toothed saw blade for rotation on an axis above said workpiece and said support surface, said blade including an advancing segment and a retreating segment, said advancing segment constituting that portion of said blade, the periphery of which is moving downwardly with respect to said support when said blade is rotating and said retreating segment constituting that portion of said blade which is moving upwardly with respect to said support when said blade is rotated;

(b) rotating said blade relative to said support and said workpiece at a speed sufficient to saw said workpiece and wherein said teeth on said advancing segment simultaneously generate and apply to said workpiece a sufficient combination of horizontal and vertical thrust to selectively move said saw with respect to said workpiece at a rate compatible with the ability of said saw to simultaneously cut said workpiece and feed said saw;

(c) adjusting the position of said blade, said support and said workpiece relative to each other during initial contact between said blade and said workpiece and continuing the adjustment until a relative position is reached between positions of blade generated maximum vertical thrust and minimum horizontal thrust on the workpiece on the one hand and blade generated minimum vertical thrust and maximum horizontal thrust on the workpiece on the other hand sufficient to effect simultaneous cutting of said workpiece and feeding of said saw relative to said workpiece;

(d) permitting said workpiece and said saw to move one with respect to the other to complete said cutting and feeding function to a predetermined degree. due solely to the rotation of the blade and the relative positions of the balde and workpiece.

* * * * *